United States Patent [19]

Goseberg et al.

[11] Patent Number: 4,680,566

[45] Date of Patent: Jul. 14, 1987

[54] COIL WITH MAGNETISABLE ROD CORE

[75] Inventors: Walter Goseberg; Alfred Pollack, both of Hanover, Fed. Rep. of Germany

[73] Assignee: Telefunken Fernseh und Rundfunk GmbH, Hanover, Fed. Rep. of Germany

[21] Appl. No.: 765,967

[22] Filed: Aug. 15, 1985

[30] Foreign Application Priority Data

Aug. 16, 1984 [DE] Fed. Rep. of Germany ..... 3429976
Jul. 18, 1985 [DE] Fed. Rep. of Germany ..... 3525649

[51] Int. Cl.[4] ..... H01F 27/28; H01F 27/34

[52] U.S. Cl. ..... 336/181; 336/136; 336/183

[58] Field of Search ..... 336/130, 136, 183, 180, 336/181, 182

[56] References Cited

U.S. PATENT DOCUMENTS

| | | | |
|---|---|---|---|
| 2,182,071 | 12/1939 | Crossley | 336/136 X |
| 2,196,809 | 4/1940 | Hoadley | 336/136 X |
| 2,507,344 | 5/1950 | Macgeorge | 336/136 X |
| 2,564,221 | 8/1951 | Hornfeck | 336/136 X |
| 2,985,854 | 5/1961 | Brosh | 336/136 X |
| 3,017,589 | 1/1962 | Chass | 336/136 |
| 3,054,976 | 9/1962 | Lipshutz | 336/136 |
| 3,089,081 | 5/1963 | Brosh | 336/136 |
| 3,113,237 | 12/1963 | Schopp et al. | 336/136 X |
| 3,197,722 | 7/1965 | Chass | 336/136 X |
| 3,594,671 | 7/1971 | Frenkel | 336/183 X |
| 3,594,672 | 7/1971 | Frenkel | 336/183 X |
| 4,229,786 | 10/1980 | Mitani et al. | 336/185 X |

*Primary Examiner*—Thomas J. Kozma
*Attorney, Agent, or Firm*—Spencer & Frank

[57] ABSTRACT

The invention concerns a coil arrangement with three windings arranged coaxially, where the outer coils are connected in series. The inductances of the outer coils are of equal magnitude and their magnetic fields have opposing polarities.

The center winding induces in the series circuit of the outer windings currents which cancel each other out. The outer windings with their stray inductances form a coil which is separated from the center one and can be applied for other purposes.

9 Claims, 5 Drawing Figures

COIL WITH MAGNETISABLE ROD CORE

BACKGROUND OF THE INVENTION

In apparatus for telecommunications, a method is well known by which coils which are magnetically coupled are arranged coaxially or superimposed on one coil form. A magnetisable iron core is immersed in the form, so as to influence the mutal coupling of the coils and the magnitude of the inductances. For simple coil arrangements, this iron core takes the form of a rod core. For a required change in the parameters, the rod core is provided with a thread and its position relative to the coils can be changed. The frequency of the current is common to the individual coil components in such a construction.

The individual windings of a coil are used with different or equal frequencies but for separate electrical applications, care must be taken that the mutal coupling of the coils is minimized. The coupling must be so small that there is no mutal magnetic effect. In order to achieve such a solution, a method is well known by which a magnetic iron core with a double E shape is used. The two E-shaped parts are so assembled here that a rectangle with two apertures is produced. The windings are made on the two outer limbs. The magnetic isolation is obtained by cutting an air gap in the outer limbs of the E-shaped iron core, whereas as the iron components are in contact in the central stem. The magnetic flux inside the individual windings is thus determined by the air gap inside the winding, while in the central stem which is common to both coils the air gap is kept as small as possible, so that the magnetic coupling of the two coils is of minimum magnitude, and this makes possible the separate use of the two coils with e.g. different frequencies. In order to secure the smallest possible air gap in the central stem when the two sections are joined together, this surface is made as flat as possible by special working. Since such an arrangement with two E-shaped iron components is very expensive, the invention is concerned with the problem of providing a coil with several windings for a variety of applications and having only one iron core.

SUMMARY OF THE INVENTION

The above problem is solved according to the present invention in that a coil with a magnetisable rod core having three coaxially positioned windings distributed roughly uniformly with respect to the rod and with the two outer windings having an approximately equal number of turns; the rod core is positioned so that it simultaneously is fully immersed in the center winding and partially or fully immersed in the two outer windings such that the two outer windings have appromimately equal inductances, the outer windings are connected in series such that their magnetic fields in the rod core are mutually opposed, and the center winding is conductively, i.e., galvanically, isolated from the two outer windings. Advantageous developments of the invention are described in the subsequent claims.

In principle, magnetic fields of different magnitudes can be produced by the application of an alternating voltage to the common axis of two series connected coils of equal inductance, depending on their relative polarities, arranged coaxially on one coil form. When the coil polarities are the same this magnetic field attains a certain value, whereas with the opposed polarities the resultant magnetic field can hardly be detected or not at all. This feature is utilised in the solution using a coil arrangement with a rod core, in order to produce coils for different tasks and with different frequencies. If a third winding is introduced between the coaxially arranged series connected and polarity opposed windings, the third coil will be approximately free of field lines from the outer windings and can be used as a separate coil. Where the inductances are different, it is advantageous to locate the coil with the larger inductance in the middle, since when a rod core is used this is fully immersed and there are no induction losses as in the outer coil due to the polarity opposed windings. Manufacturing tolerances can be compensated during assembly by displacement of the rod core, so that the outer windings have exactly the same inductances and exhibit opposed magnetic fields of equal magnitude when an alternating voltage is applied. The polarity opposed connection of the outer windings creates inductive losses. In spite of these inductive losses an adequate inductance is obtained for the outer windings as a result of stray fields.

BRIEF DESCRIPTION OF THE DRAWINGS

For the better understanding of the invention examples of the embodiments will be explained below with reference to the drawings.

FIG. 2 shows a part of a horizontal deflection circuit in a television apparatus having horizontal pincushion distortion, for which the invention can find useful application, and.

DETAILED DESCRIPTION OF THE PREFERRED EMBODIMENTS

Figure 1:
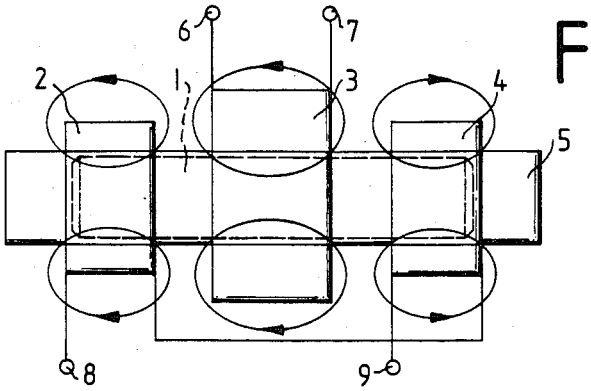
FIG. 1 shows a schematic drawing of a coil according to the invention.

FIG. 1 shows a coil with three windings 2, 3 and 4 with winding connections 6, 7, 8, and 9. The windings are coil form coaxially on a form 5. The former 5 contains a magnetisable rod core 1, which can be displaced in its position relative to the windings. The outer windings 2 and 4 are so arranged that the rod core 1 ends approximately at the outer edges of the coil. The windings 2 and 4 are series connected in such a way as to oppose each other magnetically. The direction of the magnetic fields is indicated by the sketched magnetic field lines. The relative separation of the outer windings 2,4 and their polarity ensures that the magnetic coupling of these windings is such that an adequate inductance can still be obtained. The decoupling of the centre winding 3 is optimal when the rod core is so adjusted that the magnetic fields of the outer windings 2, 4 are of equal magnitude. Since the rod core 1 is fully immersed in the centre winding 3, the field lines of this coil are closed in the way depicted, where the direction of the field lines and the applied frequency are selectable. The centre winding 3 induces in the outer windings 2 and 4 currents which are of equal magnitude and cancel each other out because of the opposing polarities.

Figure 2:
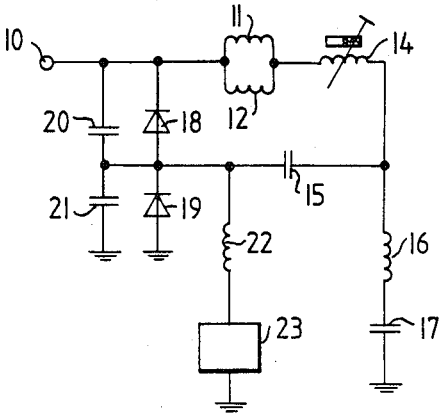

FIG. 2 shows a part of a horizontal deflection circuit in a television appartatus with an input 10, the deflection coils 11,12, the linearity adjustment 14, the tangent capacitor 15, the bridge coil 16, the parallel capacitance 17, the diodes 18, 19, the fly-back capacitors 20, 21, the horizontal drive coil 22 and the horizontal circuit 23.

In a preferred example of an embodiment according to the invention the centre winding 3 is applied as the horizontal drive coil with approximately 6 mH, and the series circuit formed by the outer windings 2, 4 is used as a bridge coil with about 1.7 mH in a television apparatus. It is advantageous for rational manufacture to effect all windings with the same wire diameter. The outer windings 2, 4 can be wound in the same direction depending on the connection sequence, or they may be wound in opposite directions. If different wire diameters are used, it is preferable to arrange the horizontal drive coil on the outer sections and the bridge coil on the centre section.

Figure 3:
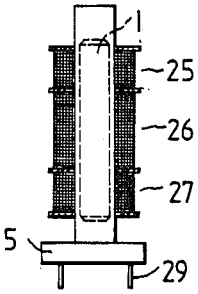
FIG. 3 shows an embodiment of a coil according to the invention.

FIG. 3 shows a rod core 1 in a coil form 5 with coil sections 25, 26, 27 and the connection pins 29. In this example of an embodiment the rod core 1 extends outside the coil sections 25 and 27. One of the advantages of a coil with equal wire diameters is an optimal winding technique, in particular with automatically manufactured coils. For this reason the coil sections 25 and 27 are wound in a single operation. This is done as follows:

Section 25 is wound, and then in section 26 a transition winding is applied up to section 27 with the same winding sense as section 25, section 27 is wound in the opposite sense to section 25. Then a transition winding is applied in section 26 in the same winding sense as section 27 and led out. Finally section 26 is wound in an arbitrary direction.

Figure 4:
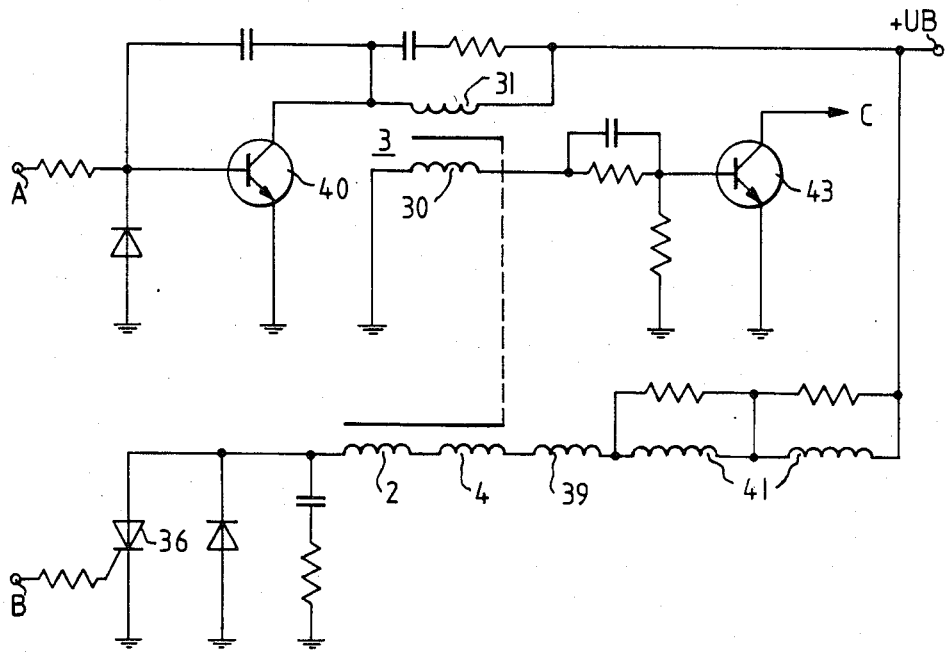
FIG. 4 shows a part of a vertical deflection circuit in a televison apparatus, having a vertical integration coil and the drive part for a horizontal deflection circuit having a line driver transformer.

FIG. 4 shows a part of a vertical deflection circuit in a television receiver having a vertical integration coil and the drive part for a horizontal deflection circuit having a line driver transformer.

Impulses are applied to the connection A from an impulse source, for the control of the current in the horizontal deflection coils. They are amplified in the transistor 40, the collector of which is connected to one end of the primary winding 31 of the line driver transformer 3. The other end of the primary winding 31 is connected to the supply voltage +UB. The impulses from the secondary winding 30 arrive at the input of the line end transistor 43, from the collector connection C of which the non-illustrated horizontal deflection coils and the line transformer are driven.

Impulses for the vertical deflector are applied to the connection B from an impulse generator. Thyristor 36 is to be taken as a switch, by means of which the horizontal fly-back impulses, applied in synchronism with the horizontal frequency to the series connection of the vertical deflection coils 41 with the vertical integration coil 2, 4, are switched from the winding 39 of the line transformer which is also connected in series. The waveform of the vertical deflection voltage is so shaped by the vertical integration coil 2, 4 that lines with equal vertical separation are described on the picture screen.

The coils 30, 31 and 2, 4 are arranged on a rod core 1 which is indicated by the linking dotted line as a common iron core.

Figure 5:
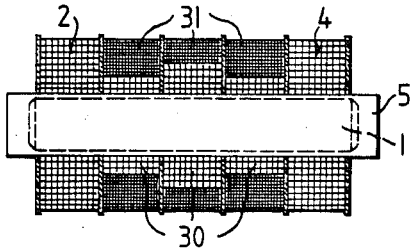
FIG. 5 shows the arrangement according to the invention of the windings for the line driver transformer and for the vertical integration coil according to FIG. 4.

FIG. 5 shows the arrangement of the windings for the line driver transformer and for the vertical intergration coil according to FIG. 4.

The iron core 1, formed as a rod core, is arranged in a coil form 5 having five coil sections, substantially centrally with respect to the sections. The outer sections contain the coil components of the vertical intergration coil 2, 4 having opposed polarities. As a result of this opposed polarity winding method, stray fields are kept so remote that an expensive ferrite container is not necessary for shielding purposes.

The line driver transformer is distrubuted in the three middle sections. The secondary winding 30 is disposed as the under winding adjacent the iron core 1. The winding distribution is so selected that the middle section has a greater number of secondary turns than the adjacent sections, whereby an optimum field distribution is made possible, so that an opposite influence from the line driver transformer and the vertical intergration coil can be minimized. On account of the larger cross section of wire, and also on account of the high currents, it has proved to be desirable to arrange the secondary coil in the under-coil positions of the three middle sections. Desirably these are wound with the same wire as used for the vertical integration coils.

The primary winding 31 is applied as the last winding on the secondary winding 30 which lies underneath.

We claim:

1. In a coil with a magnetisable rod core having three adjacent coaxially positioned windings distrubuted roughly uniformly with respect to said rod core, and in which the two outer windings have approximately equal numbers of turns, the improvement wherein: said rod core is immovably positioned so that it is fully immersed in the third centre winding and at least partially immersed in said outer windings so that said outer windings have approximately equal inductances; said outer windings are connected in series opposition such that when an alternating voltage is applied across said outer windings, their magnetic fields in said rod core are mutually opposed, whereby the mutual coupling between said centre wwinding and said series connected outer windings is minimized; said centre winding of a of is the primary or secondary winding of a line drive transformer and is conductively isolated from said outer windings; a further winding forming the other of said secondary or primary windings of said transformer is disposed only above said centre winding; and said outer windings which are connected in series are arranged as a vertical integration coil for a television apparatus.

2. Coil according to claim 1, wherein all said windings are wound in the same sense.

3. Coil according to claim 1, wherein said outer windings are wound in opposite senses.

4. Coil according to claim 1, wherein said the rod core consists of a ferromagnetic material, in particular ferrite.

5. Coil according to claim 1, wherein said outer windings and said further winding are wound with wire of the same diameter.

6. Coil according to claim 1, wherein said centre winding has the greater inductance.

7. Coil according to claim 1, wherein said outer windings are so executed that these windings achieve a sufficient inductance.

8. A coil according to claim 1, wherein said centre winding is the secondary winding of the line drive transformer.

9. A coil according to claim 8, wherein the turns of said center winding are symmetrically distrubuted in three coaxial sections with the number of turns in the center section being greater than the number of turns in the outer sections.

* * * * *